United States Patent [19]

Holmgren

[11] 4,447,977

[45] May 15, 1984

[54] MULTI-FACETED FIRING DEVICE

[76] Inventor: Steven A. Holmgren, 2150 Wilson Ave., Apt. #326, St. Paul, Minn. 55119

[21] Appl. No.: 344,762

[22] Filed: Feb. 1, 1982

[51] Int. Cl.[3] ..... F41C 19/00

[52] U.S. Cl. ..... 42/51; 42/69 R; 42/70 R

[58] Field of Search ..... 42/51, 69 R, 70 R, 70 F

[56] References Cited

U.S. PATENT DOCUMENTS

| | | | |
|---|---|---|---|
| 24,228 | 5/1859 | Mock | 42/69 R |
| 25,244 | 8/1859 | Briggs . | |
| 1,521,286 | 9/1924 | Fisher . | |
| 1,608,359 | 1/1926 | Biason . | |
| 2,069,293 | 2/1937 | Wiley | 42/69 R |
| 2,499,379 | 12/1944 | Garrett . | |
| 2,902,788 | 4/1958 | Laager . | |
| 3,626,621 | 12/1971 | Ido . | |
| 3,680,241 | 8/1972 | Ramsay . | |
| 3,757,447 | 9/1973 | Rowe . | |
| 3,849,924 | 11/1974 | Whitlinger . | |
| 4,065,867 | 1/1978 | Storey . | |

*Primary Examiner*—Charles T. Jordan

*Attorney, Agent, or Firm*—Orrin M. Haugen; Thomas J. Nikolai; Douglas L. Tschida

[57] ABSTRACT

A muzzle-loading gun including a hammer and a trigger configured so that the gun can only be armed by coordinated, simultaneous actuation of both the hammer and the trigger.

7 Claims, 6 Drawing Figures

MULTI-FACETED FIRING DEVICE

BACKGROUND OF THE INVENTION

This invention relates generally to muzzle-loading firearms and more particularly to the design of a firing mechanism for use in weapons of this type.

Muzzle-loading firearms have been around for centuries and, of late, have become increasingly popular for target and sport shooting. This type of weapon is loaded by introducing a powder charge and a ball or pellet into the barrel through the muzzle of the weapon. A percussion cap, arranged to be struck by a hammer, is employed for igniting the powder charge when the trigger is pulled.

SUMMARY OF THE INVENTION

The present invention relates to an improved firing device for use with muzzle-loading guns which is simple in construction and reliable in operation. The firing mechanism comprises a pistol-like frame which supports only three moving parts, namely, the trigger, a hammer and a hammer spring. Secured to the frame is a breech member which is threaded so as to receive mating threads formed on the barrel. Proper attention is paid to the weight of the barrel and that of the frame so that the balance point for the weapon is directly over the user's trigger finger. When used as a rifle, a stock can be appended to the firing device and, again, through proper attention to the relative weight of the barrel relative to the stock, the desired balance point is maintained. By this means, the tendency for the gun to kick is greatly reduced over prior art weapons, allowing smoother firing and greater accuracy.

Furthermore, the trigger and hammer are configured to provide a special safety mechanism which serves to enhance the relative safety in handling and transporting the weapon. This mechanism inhibits intentional or careless arming and firing of the gun by persons, especially small children, not familiar with its operation.

Various other advantages and features of novelty which characterize the invention are pointed out with greater particularity in the claims annexed hereto and forming a party hereof. However, for a better understanding of the invention, its advantages, and objects attained by its use, reference should be made to the drawings which form a further part hereof and to the accompanying descriptive matter, in which there is illustrated and described a preferred embodiment of the invention.

BRIEF DESCRIPTION OF THE DRAWINGS

In the drawings, in which like reference numerals indicate corresponding parts throughout the several views.

DESCRIPTION OF THE PREFERRED EMBODIMENT

Figure 1:
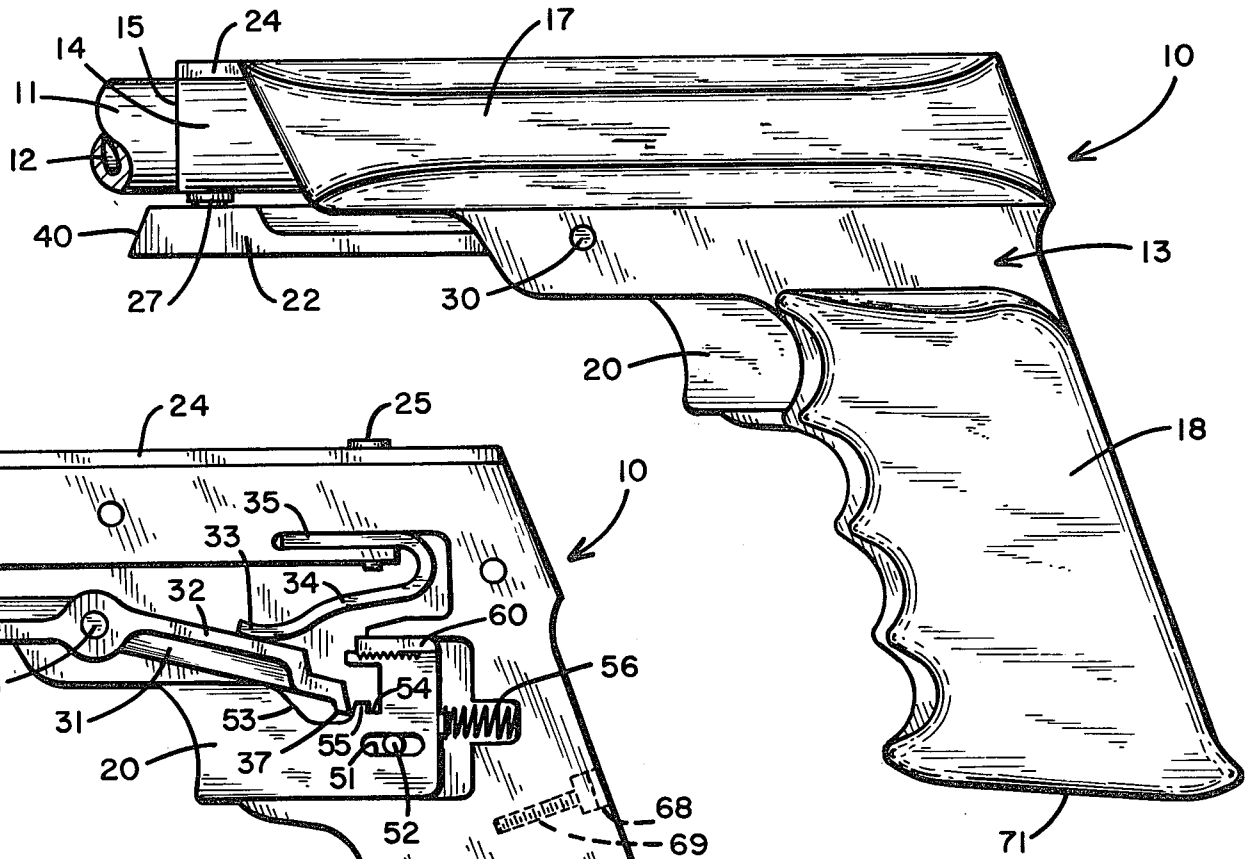
FIG. 1 is a side view of the multi-faceted firing device according to the invention.
Figure 5:
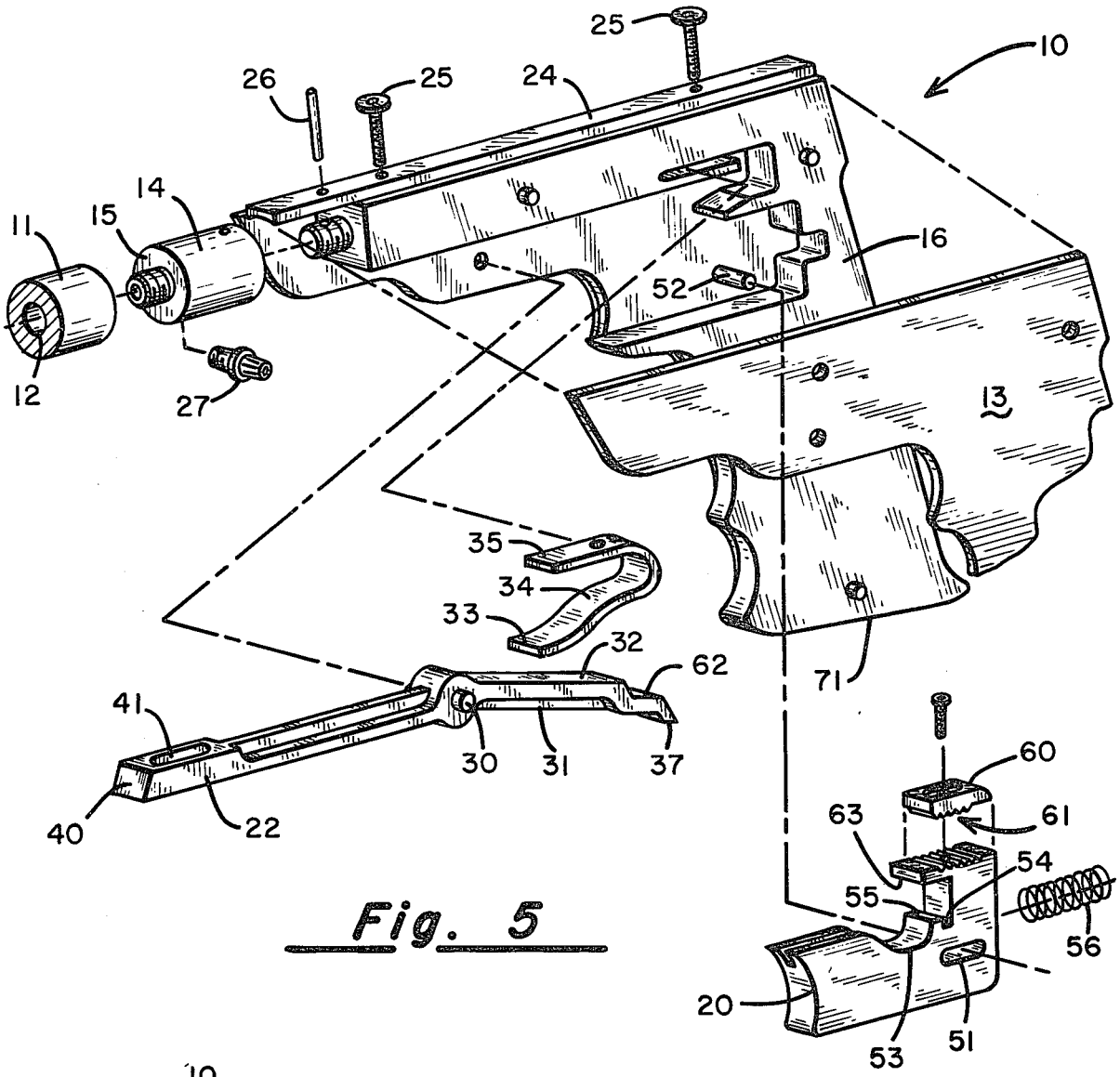
FIG. 5 is a blow-apart view showing further constructional features of the individual parts comprising the invention.

With reference to FIG. 1 of the drawings, the multi-faceted firing device of the present invention is indicated generally by numeral 10 and comprises a barrel 11 having a bore 12, and a side plate 13 which includes a breech block 14 to which the barrel is joined at 15, as by threading. Side plate 13 further comprises a frame 16 (FIG. 2), an upper stock 17 and a lower grip 18. Slideably mounted within the frame 16 is a trigger 20 which cooperates with one end of a hammer 22. Secured to the top of the frame is a rib member 24 which accommodates a rear sight (not shown) and which receives fasteners 25 for mounting a telescopic sight should this be desired. The breech block 14 is internally threaded at its right-most end so as to receive a threaded projection on the frame 16. A pin 26 prevents rotation of the breech relative to the frame. Screwed into the underside of the breech block 14 is a nipple 27 which communicates by means of a right-angle passage 28 with the bore 12 of the barrel 11. The nipple is best shown in the blown-apart drawing of FIG. 5 and includes an externally threaded cylindrical portion which screws into a threaded bore in the breech block 14. To facilitate the attachment and removal of the nipple 14, the conical portion which frictionally receives the percussion cap has a hexagonal bore for receiving an Allen wrench therein.

Figure 2:
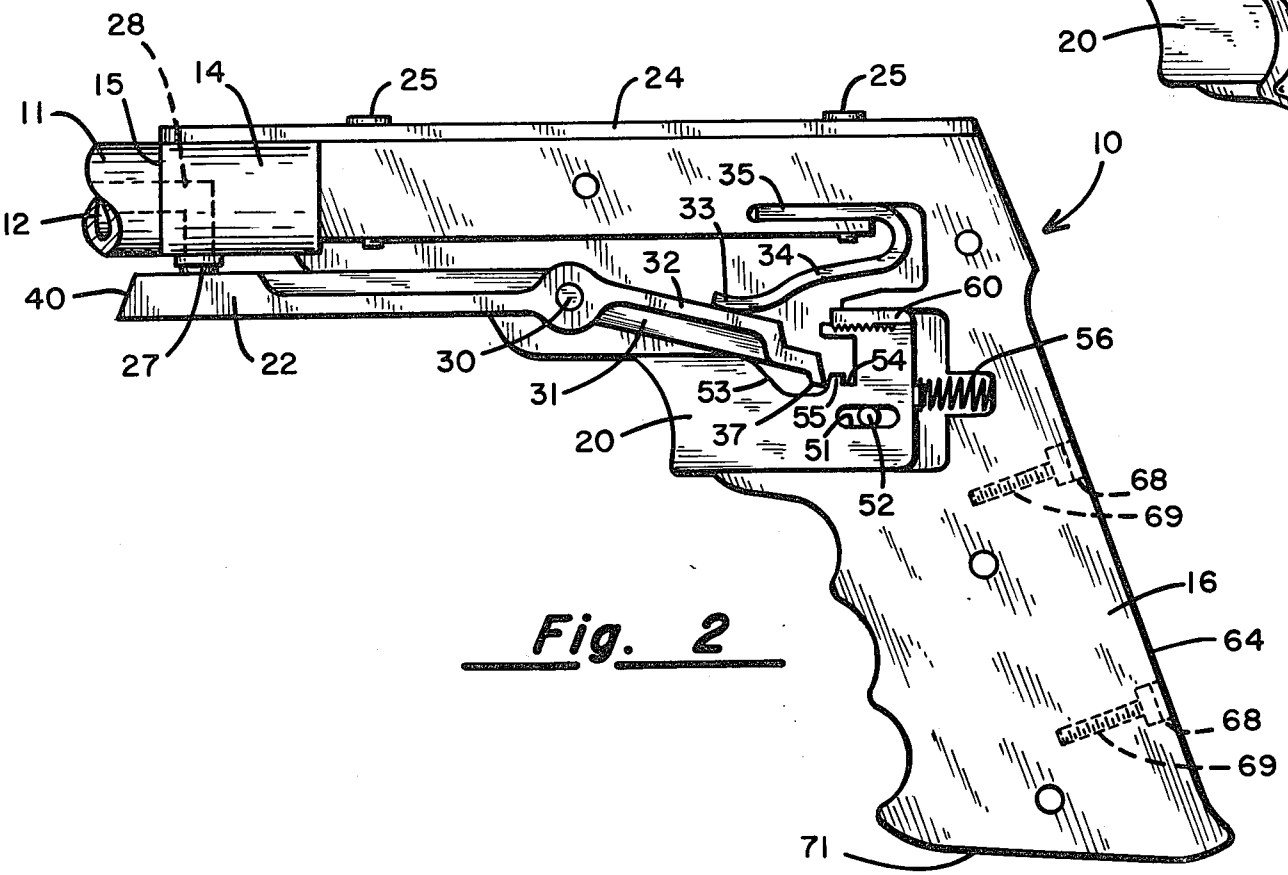
FIG. 2 is a side view with the grip and side plate removed to expose the working mechanisms of the gun when in the "fired" condition.

With continued attention to FIG. 2, it may be seen that the hammer 22 is pivotally mounted with respect to the frame 16 at pivot pin 30. The hammer has a first end 31 arranged for engagement at a surface 32 with one end of a leaf-type hammer spring 34, the other end 35 of which is secured in the frame 16 by the fastener 25. The right-most end of the hammer 22 (when viewed as in FIG. 2) terminates in a hook 37 for a purpose which will be presently set forth. The left-most end 40 of the hammer 22 is provided with a oval-shaped cavity 41 (FIGS. 3 & 5) for receiving the exposed portion of the nipple 27 when the weapon is fired. Prior to firing and, as a part of the "arming" operation, a percussion cap is frictionally fit over the conical portion of the nipple 27 and held there until struck by the hammer upon firing. Because of the oval shape of the recess 41 formed in the hammer, the percussion cap, upon explosion, tends to split rather than fragment and this prevents shrapnel-like particles from flying about upon percussion. It may also be seen that a through-hole 42 is formed from the bottom surface of the hammer through to the oval recess 41. This aperture tends to relieve gas pressure, also aiding in reducing the possibility of the percussion cap fragmenting. The aperture 42 also provides a convenient means whereby a wire probe may be inserted into the nipple 27 for clean-out purposes.

The trigger 20 slides in a groove 50 (FIG. 3) in the frame 16 and is guided in its motion by the walls of this groove. Formed through the thickness dimension of the trigger is a longitudinal slot 51 through which is passed a pin 52. The pin 52 prevents the trigger from falling out unintentionally during disassembly.

The upper surface of trigger 20 includes recess 53 and a notch 54 separated by a ridge 55. The recess 53 is deeper than notch 54 by a predetermined amount. A tab 60 is secured to the top portion of the trigger member 20 by a suitable fastener and it includes inter-engaging serration 61 cooperating with mating serration on the trigger 20. By this means, precise lateral adjustment of the tab 60 along the trigger 20 can be made. As will become more apparent from the following description, the adjustment of the tab 60 along the top surface of the trigger 20 provides a pull adjustment feature.

When it is desired to fire the gun, the load is inserted into the muzzle in conventional fashion. To arm the gun, the user engages the end 40 of the hammer 22 with his thumb and forefinger to pivot the hammer in a counter-clockwise direction about the pivot 30, maintaining the trigger position as he does so. When the hammer reaches the position shown in FIG. 3, trigger 20 is allowed to move forward by the action of the coil spring 56 until the hook 37 of the hammer 22 engages the upper surface of the trigger and the end of tab 60 which limit the movement of the trigger. A cap is now inserted on the nipple 27 and the gun is ready to be fired. With continued reference to FIG. 3, pulling the trigger 20 against the force of spring 56 releases the hook 37 from the upper trigger surface. The length of pull required is determined by the setting of tab 60 as previously explained. Once the hook 37 clears the top surface of the trigger, the hammer spring 34 swiftly pivots the hammer 22 such that the percussion cap secured to the nipple 27 is struck by the bottom of the oval recess 41. The striking force causes the percussion cap to explode and to thereby ignite the charge in the bore 12 of the barrel via the right-angle port 28.

The position of the hammer, trigger and hammer spring immediately following firing is as illustrated in FIG. 2. That is to say, the hook 37 of the hammer abuts the bottom of the recess 53 and the shoulder defined by the ridge 55. This precludes further forward movement of the trigger 20.

Figures 3, 4:
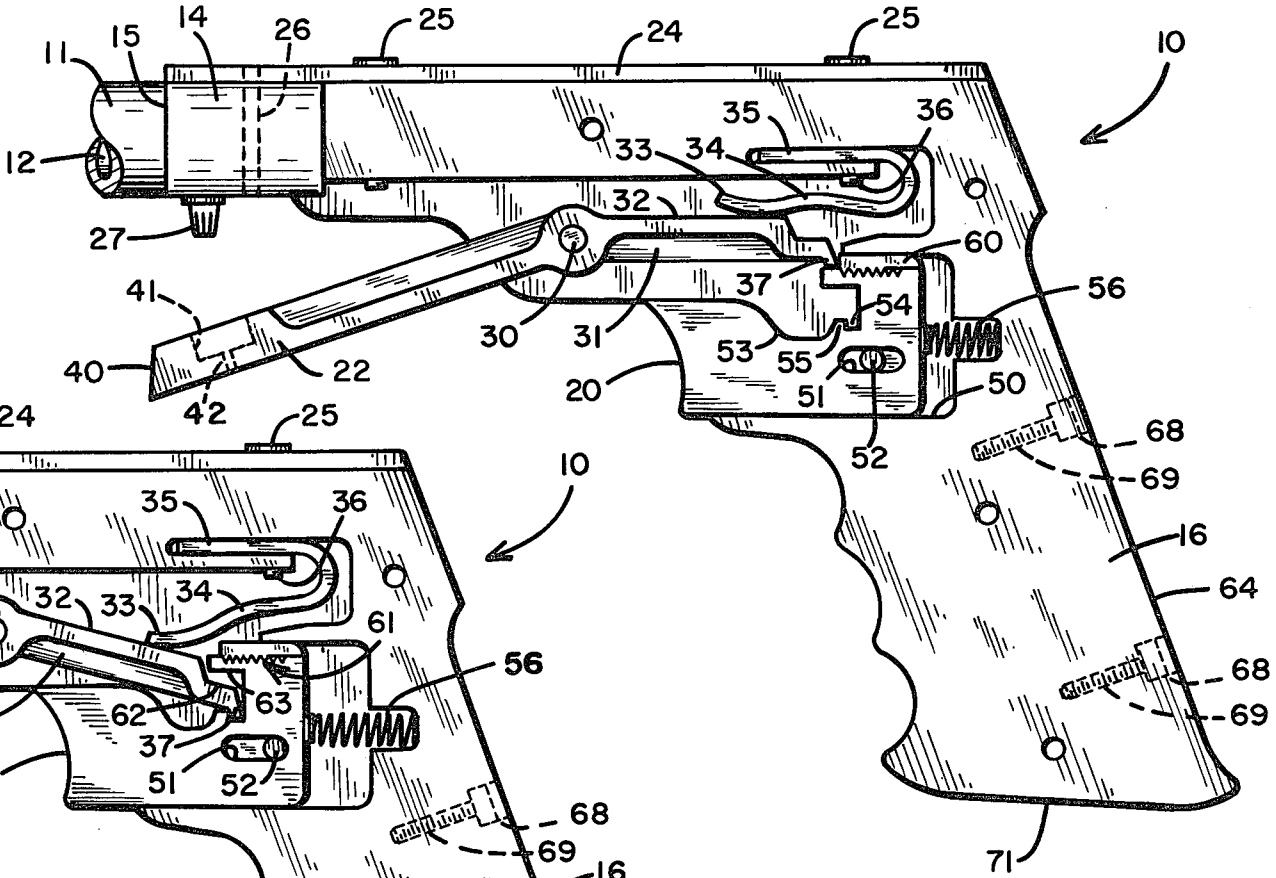
FIG. 3 shows the mechanism of the gun in an "armed" condition.
FIG. 4 shows the mechanism of the gun in its "relative safety" condition.

A relative safety feature of the multi-faceted firing device will now be explained with particular reference being given to FIGS. 2 and 4 of the drawings. It is to be noted first that simply pulling trigger 20 when the hammer is in the position shown in FIG. 2 accomplishes nothing. If arming of the weapon is attempted by moving hammer 22 counter-clockwise about the pivot 30 while the trigger is left undepressed, spring 56 displaces the trigger 20 to the left as soon as the hook 37 rises above the edge of the ridge 55. The hammer spring 34 then moves the hook 37 into the recess 54 as shown in FIG. 4. Further motion of the hammer 22 is precluded because of the engagement between the upper surface 62 of the hook portion of the hammer and the overhang 63 of the trigger.

To release the safety so that the hammer can be moved to its cocked position, the hammer 22 is pivoted slightly counter-clockwise, to lift hook 37 out of the recess 54 and, simultaneously, trigger 20 is pulled to a point where further pivotal movement of the hammer is possible. A percussion cap can now be inserted onto the nipple 27. It can be seen, then, that it is necessary for both the hammer and the trigger to be operated, in a coordinated fashion, in order to arm the piece. Trigger action alone does nothing, and hammer action alone simply establishes the safety condition.

Once the weapon is armed by inserting a load into bore 12 of the barrel and placing a percussion cap on the nipple 27, the weapon may still be handled with relative safety when the hammer is positioned such that its hook 37 resides in the notch 54. In this position, the hammer is held sufficiently far from the live percussion cap so that even if the weapon should be dropped, the hammer cannot strike the percussion cap.

Figure 6:
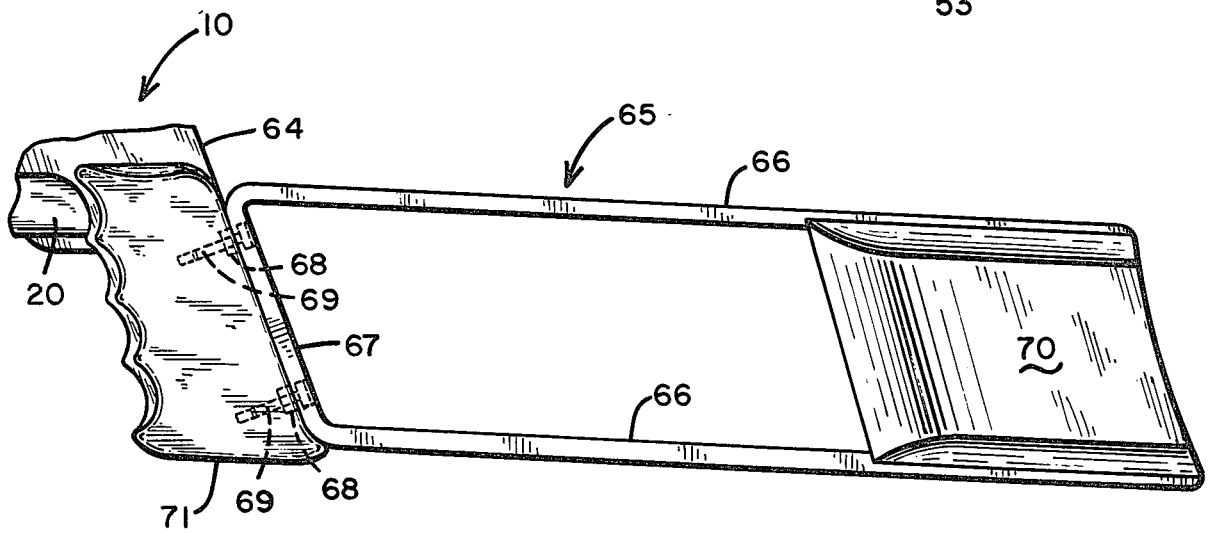
FIG. 6 illustrates the manner in which an additional stock member may be attached to the multi-faceted firing device for converting it to a rifle-type weapon.

The multi-faceted firing device of the present invention may readily be converted to a rifle-type weapon by attaching a stock to the rear edge 64 of the frame 16. A preferred form of rifle stock attachment is illustrated in FIG. 6. Shown in this view is a metal frame 65 having parallel leg portions 66-66 and a connecting portion 67 thereof bent appropriately so as to conform to the natural slope of the hand grip portion of the gun as shown in FIG. 1. First and second threaded apertures 68 are formed in the frame 16 (FIG. 2) to receive mounting screws 69. Positioned at the opposed end of the metal frame 64 are wooden blocks 70 which are decoratively shaped so as to conform with the overall appearance of the stocks 17 and grips 18 of the weapon. The thickness of the wooden inserts 70 are such as to provide a predetermined surface area and shape which is adapted to comfortably engage the user's shoulder when the weapon is being fired as a rifle. In this regard, it should be understood that the barrel 11 of a greater length and weight may be employed when the invention is used as a rifle so as to counterbalance the additional weight of the rifle stock assembly 65, leaving the balance point directly over the user's trigger finger.

From the above, it will be evident that the invention comprises a muzzle-loading gun of improved balance and reliable operation, with means for adjusting the trigger pull required to fire the piece, with means for automatically establishing a safety condition unless trigger and hammer are actuated in a predetermined coordinated fashion during the arming operation. The mechanism is "bottom firing", thus leaving an uninterrupted path along the rib 24 as a sight path. That is, the hammer is not in the line of sight of the user. The slant of the handle with respect to the upper stock and barrel assembly is approximately 70° and when used as a handgun, fits comfortably in the palm of the hand when the thumb is made to rest in the space between the stock 17 and the lower grip 16. When so held, there is no tendency for the wrist to cock. Furthermore, improved balance is obtained by appropriately weighting the handle frame so that the center of rotation or balance point is just above the user's trigger finger. The base 71 of the frame makes a slight angle of approximately 5°–15° with respect to the horizontal. By providing this slight angle, the butt of the piece tends to conform to the user's nontrigger finger hand when the weapon is being fired in the two-hand position of gripping. Finally, since the barrel is removable and replaceable, a variety of barrels of differing bore size may be used to accommodate balls of differing calibers.

The invention has been described herein in considerable detail, in order to comply with the Patent Statutes and to provide those skilled in the art with the information needed to apply the novel principles and to construct and use such specialized components as are required. However, it is to be understood that the invention can be carried out by specifically different equipment and devices and that various modifications, both as to equipment details and operating procedures can be effected without departing from the scope of the invention itself.

I claim:

1. A firing device for a muzzle-loading weapon comprising a barrel and a stock, said barrel having a central bore and said stock including a frame, a breech block adapted to receive said barrel, and a trigger, a trigger spring, a hammer, and a hammer spring below said barrel;

said breech block including a right-angle bore communicating with the bore of said barrel, and further having a downward nipple, communicating with said right-angle bore, for impacting by a percussion cap to ignite a charge of powder in said breech;

said hammer having first and second spaced ends and being pivotally mounted in said frame at a site between said ends for pivotal movement between an "armed" position and a "fired" position, said first end being configured for manual engagement to move said hammer into said "armed" position, and including a cavity apposed to said breech for receiving a percussion cap, disposed on said nipple when said hammer moves to said "fired" position;

said hammer spring engaging said second end of said hammer for urging said hammer into said "fired" position;

said trigger being mounted in said frame, in proximity to said second end of said hammer, for sliding movement, aligned with said barrel, and having a first surface for engaging said second end of said hammer to maintain said hammer in said "armed" position;

and said trigger spring urging said trigger toward said second end of said hammer.

2. A firing device according to claim 1 in which said second end of said hammer is configured as a hook, and said trigger is configured with a recess, in which said hook is retained by said hammer spring in a "safe" position of said hammer, said safe position being located between said "armed" and "fired" positions of said hammer, to prevent said pivotal movement of said hammer.

3. A gun according to claim 1 in which said trigger includes a tab adjustable along said first surface for engagement by said second end of said hammer to limit the movement of said trigger toward said hammer and hence limit the length of pull of said trigger required to release said hammer.

4. A gun according to claim 1 in which said cavity includes a gas release port.

5. A gun according to claim 1 in which said stock includes upper and lower, mutually spaced grips positioned so that the weapon is balanced above the user's trigger finger.

6. In a muzzle loading hand weapon, in combination:

a hammer pivoted for motion between an "armed" position and a "fired" position;

a hammer spring urging said hammer into said "fired" position;

a trigger slidably mounted adjacent to said hammer in alignment with one end of said hammer;

and a trigger spring urging said trigger towards a normal position, said trigger having a first surface for engaging said one end of said hammer for maintaining said hammer in said "armed" position while said trigger is in said normal position and said trigger being further configured with a recess so that when said hammer is moved from said "fired" position towards said armed position, said trigger spring slidably urges said trigger towards said normal position until said recess receives said one end of said hammer and prevents further pivotal movement of said hammer.

7. Apparatus according to claim 6 in which said recess includes a ridge and said one end of said hammer is formed as a hook, so that when said one end is received in said recess, said hook engages said ridge and prevents sliding movement of said trigger thereby operates as a safety.

* * * * *